US006935557B2

(12) United States Patent
Aubry et al.

(10) Patent No.: US 6,935,557 B2
(45) Date of Patent: Aug. 30, 2005

(54) SEPARABLE BOWL FORMING CARTON

(75) Inventors: Bethany A. Aubry, Rochester, NY (US); Dennis Bacchetta, Webster, NY (US); Lesley Bethune-Bates, Rochester, NY (US); MaryAnn Hussar, Henrietta, NY (US); Mark McOmber, Penfield, NY (US); Lisa V. Palvino, Rochester, NY (US); David Rydell, Pittsford, NY (US); Thomas Simmons, Rochester, NY (US); Scott D. Sylvester, Basom, NY (US); David Ziemba, Avon, NY (US)

(73) Assignee: Diamond Paper Box Co., Inc., Rochester, NY (US)

( * ) Notice: Subject to any disclaimer, the term of this patent is extended or adjusted under 35 U.S.C. 154(b) by 28 days.

(21) Appl. No.: 10/713,323

(22) Filed: Nov. 14, 2003

(65) Prior Publication Data

US 2005/0103833 A1 May 19, 2005

(51) Int. Cl.[7] ..... B65D 5/54; B65D 17/28

(52) U.S. Cl. ..... 229/235; 229/101; 229/123; 229/120.011

(58) Field of Search ..... 229/101, 123, 229/120.011, 235, 903; 206/766; 426/111, 113, 114, 115, 122, 123

(56) References Cited

U.S. PATENT DOCUMENTS 2,793,802 A * 5/1957 Scaturro ..... 229/123
2,865,498 A * 12/1958 Ringler ..... 206/268
3,276,667 A * 10/1966 Johnson ..... 229/235
3,309,005 A * 3/1967 Pilger ..... 229/101
3,412,924 A 11/1968 Krzyzanowski
3,418,139 A 12/1968 Craig
3,539,093 A 11/1970 Massengill
3,873,017 A * 3/1975 Blatt ..... 229/235
3,884,348 A * 5/1975 Ross ..... 229/235
3,886,901 A * 6/1975 Zeitter ..... 229/101
4,091,929 A 5/1978 Krane
4,125,185 A 11/1978 Bliss
4,244,470 A 1/1981 Burnham
4,248,901 A 2/1981 Austin
4,586,649 A * 5/1986 Webinger ..... 229/903
4,746,010 A * 5/1988 Fournier ..... 229/235
4,765,533 A * 8/1988 Hoshiko et al. ..... 229/101
5,042,660 A 8/1991 Carver
5,253,802 A * 10/1993 Bernard et al. ..... 229/903
5,364,018 A 11/1994 Carlsson
5,538,179 A 7/1996 Cai
5,855,315 A 1/1999 Roseth
6,027,017 A 2/2000 Kuhn et al.
6,481,618 B2 11/2002 Persson
6,523,692 B2 2/2003 Gregory
2002/0014522 A1 2/2002 Heely et al.
2002/0040924 A1 4/2002 Persson

* cited by examiner

*Primary Examiner*—Gary E. Elkins
(74) *Attorney, Agent, or Firm*—Brian B. Shaw, Esq.; Stephen B. Salai, Esq.; Harter, Secrest & Emery LLP

(57) ABSTRACT

A separable bowl forming carton retains an inner package, wherein the separable bowl forming packaging is selectively separated into separate components which can be deformed along preset fold lines to define a bowl periphery having a greater number of facets than the sealed separable bowl forming carton.

8 Claims, 6 Drawing Sheets

FIGURE 3
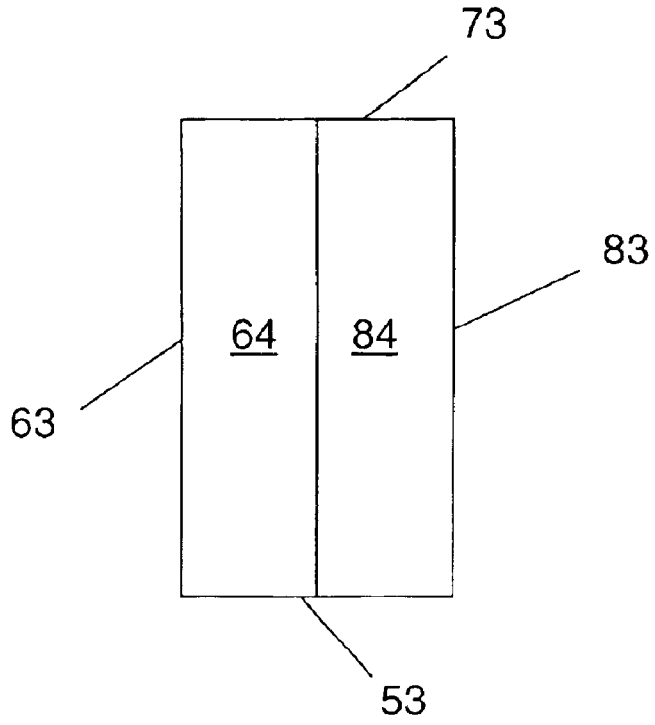
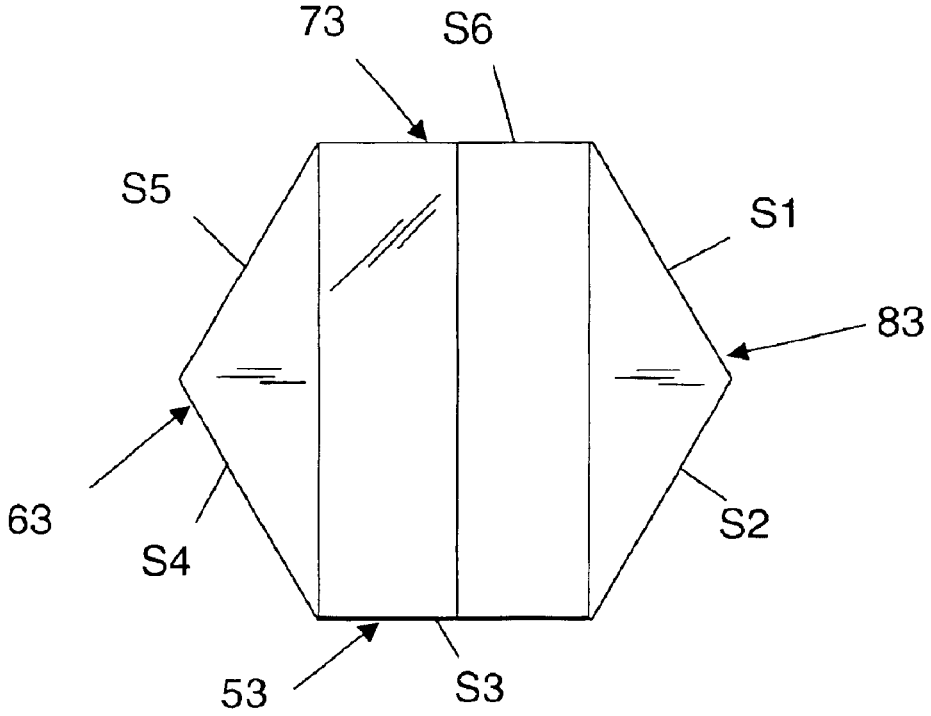
FIGURE 4

SEPARABLE BOWL FORMING CARTON

CROSS-REFERENCE TO RELATED APPLICATIONS

None.

STATEMENT REGARDING FEDERALLY SPONSORED RESEARCH OR DEVELOPMENT

None.

REFERENCE TO A "SEQUENCE LISTING"

Not applicable.

BACKGROUND OF THE INVENTION

1. Field of the Invention

The present invention relates to a carton for food products and a blank for forming such carton, wherein the carton can encompass an inner sealed food packet and can be separated to form individual bowls for receiving the contents of the inner food packet for an aesthetically pleasing presentation to consumers.

2. Description of Related Art

There are numerous containers for packaging food products. These packages typically include an outer cardboard or paperboard container, with a food product within, or alternatively employ an inner sealed flexible bag. Typically, in use, the consumer opens the outer paperboard container and then the sealed inner container to access the food product. If the food product is not consumed in one sitting, the inner flexible bag is typically folded over to provide some sealing function of the retained food product and the cardboard container is closed.

The need exists for a carton which can provide sufficient cushioning and packaging functions to allow transport of the food product, while still providing an aesthetically pleasing presentation of the food product to the consumer. The need also exists for a carton that can allow shipment of different food products within a common sealed container, wherein the different food products can be separately presented without mixing.

BRIEF SUMMARY OF THE INVENTION

The present invention provides a separable bowl forming carton, wherein the carton is separable into two separate bowls. In one configuration, the carton is sized to enclose at least one inner packet, and preferably two inner packets. The outer surface of the separable bowl forming carton includes promotional labeling and description of the food product, to allow the consumer to make an informed purchasing decision.

In use, the consumer opens and divides the carton into separate halves, wherein each half is deformable into a multifaceted bowl, such that the consumer can empty each of the retained inner packets into a respective bowl for presentation and consumption. In one configuration, the periphery of the bowl has more facets than the number of side walls of the separable carton.

The present separable bowl forming carton can be constructed from a unitary blank having four sections, each section including a top closure flap, an upper wall panel, a lower wall panel and a bottom closure flap, wherein the upper and lower wall panels are separable by a tear strip, and at least one of the wall panels includes bowl forming fold lines.

BRIEF DESCRIPTION OF THE SEVERAL VIEWS OF THE DRAWING(S)

FIG. 3 is a top plan view of the sealed carton.

FIG. 4 is a top plan view of a resulting bowl.

DETAILED DESCRIPTION OF THE INVENTION

Figure 1:
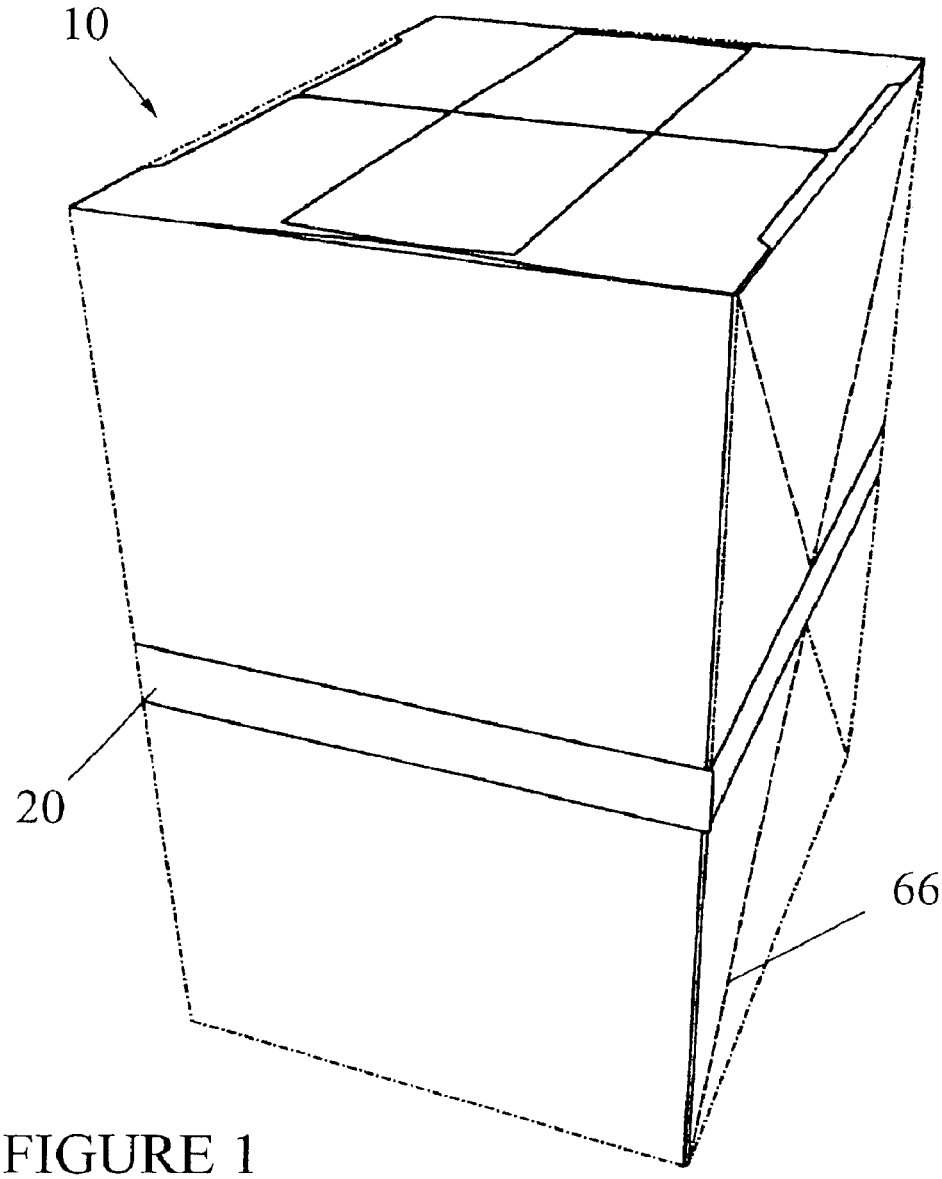
FIG. 1 is a perspective view of a sealed separable bowl forming carton.

Referring to FIG. 1, the present separable bowl forming carton 10 has closed, and preferably sealed top, bottom and side walls. As seen in FIGS. 1, 2, 5, 6 and 7, a tear strip 20 extends across each of the side walls, at a generally median height of the carton 10.

Figure 6:
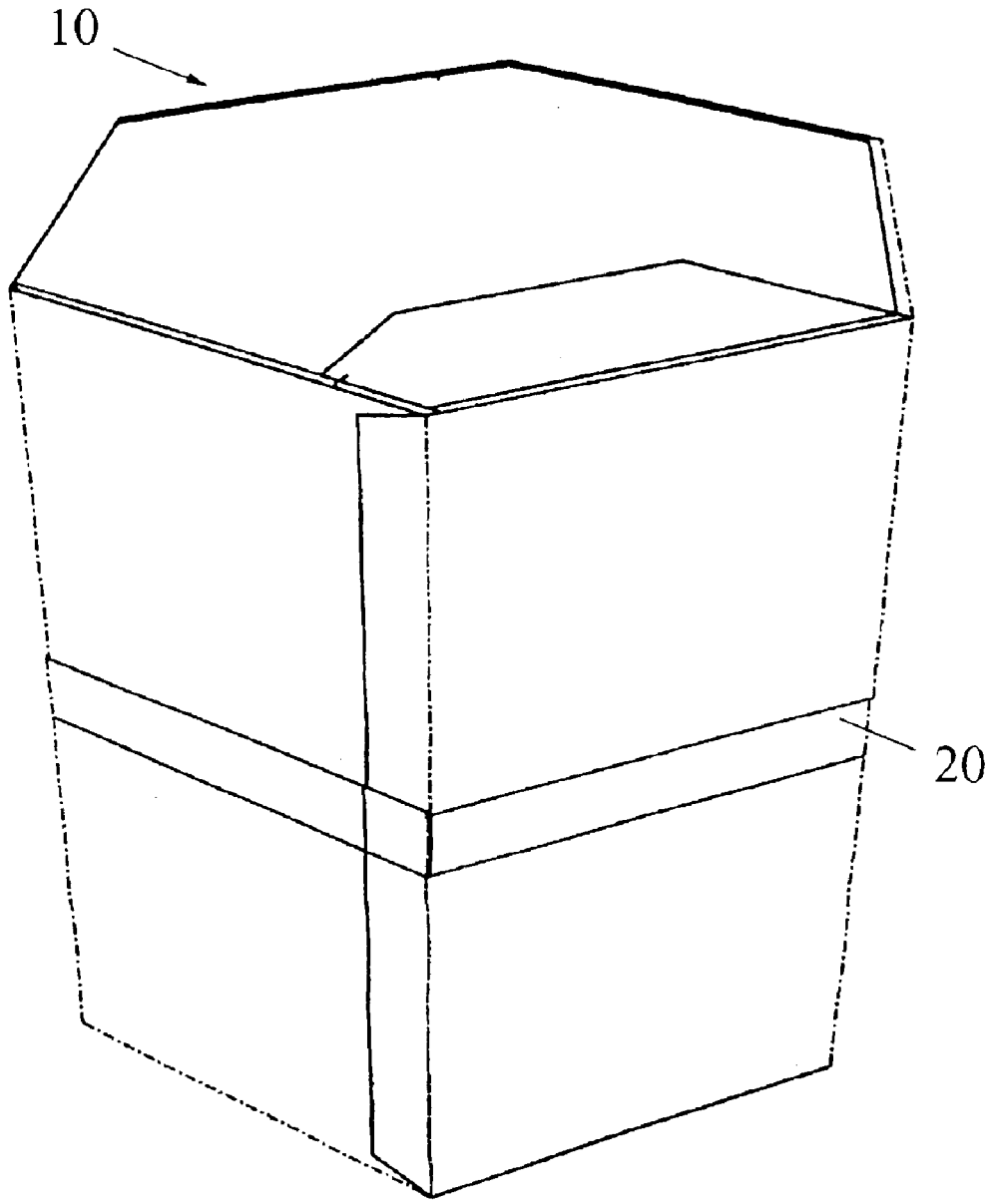
FIG. 6 is a perspective view of an alternative separable bowl forming carton.
Figure 7:
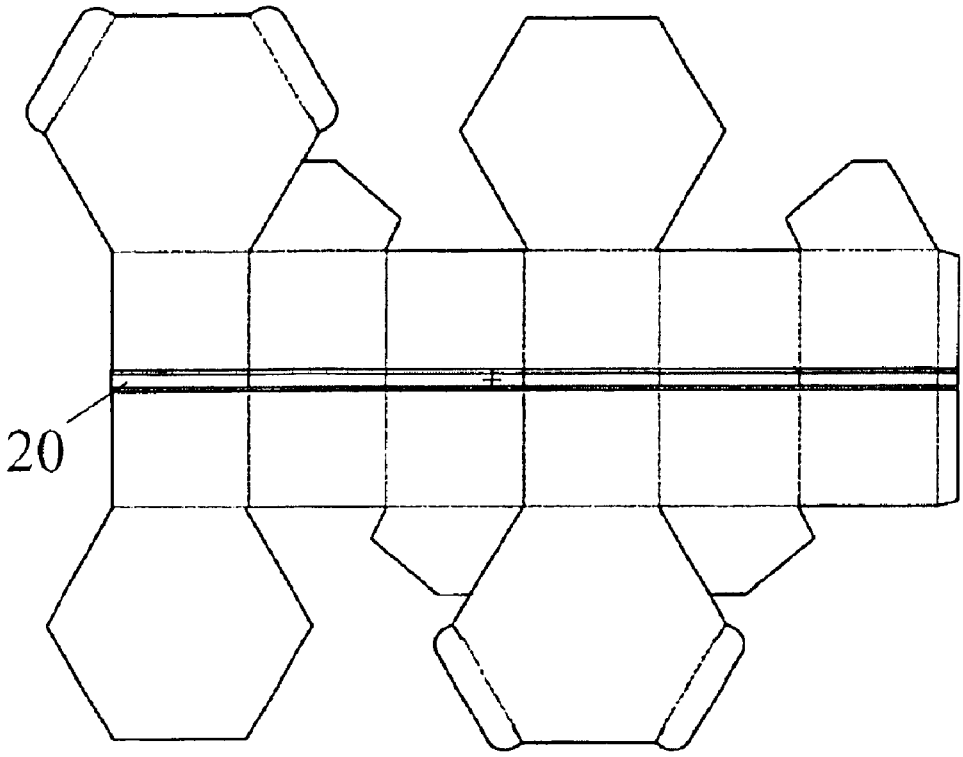
FIG. 7 is a top plan view of a blank for forming the separable bowl forming carton of FIG. 6.

Although the present configuration is set forth in terms of having four side walls, it is understood the separable bowl forming carton can have three, five or more side walls. Specifically, as seen in FIGS. 6 and 7, the separable bowl forming carton 10 can have six side walls.

Figure 2:
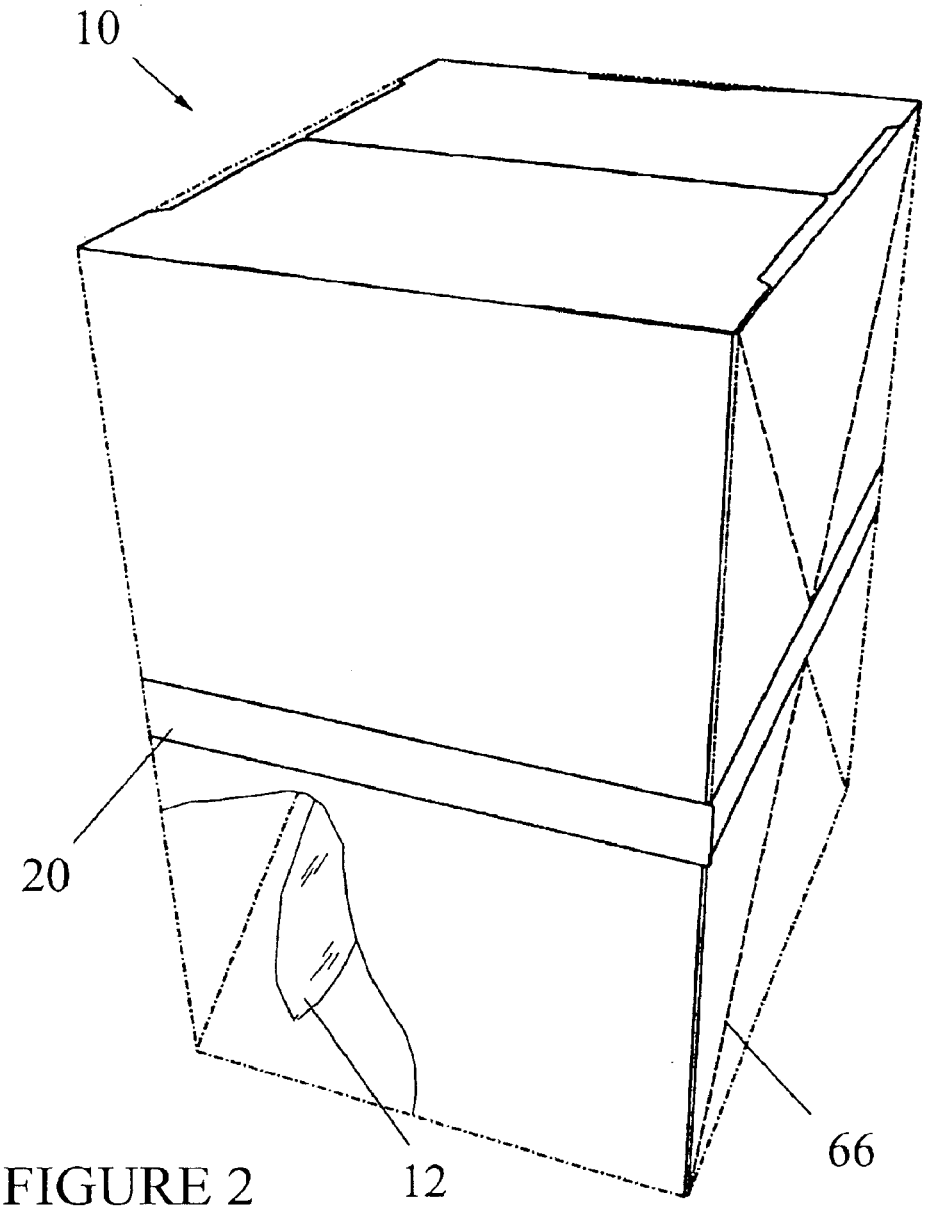
FIG. 2 is a partial cut away view showing an inner packet within the separable bowl forming carton.

As seen in FIG. 2, at least one inner packet 12 of food product is retained within the separable bowl forming carton 10. The inner packet 12 can be any variety of known package constructions including flexible laminates, bags or even paperboard.

Referring to FIGS. 3 and 4, the sealed carton 10 is shown having four side walls (FIG. 3) and the resulting bowl (FIG. 4) has an opening (or periphery) defined by six linear segments. Depending upon the configuration of side walls, the resulting bowl can have eight wall facets defining a bowl opening having six linear segments S1, S2, S3, S4, S5 and S6.

Figure 5:
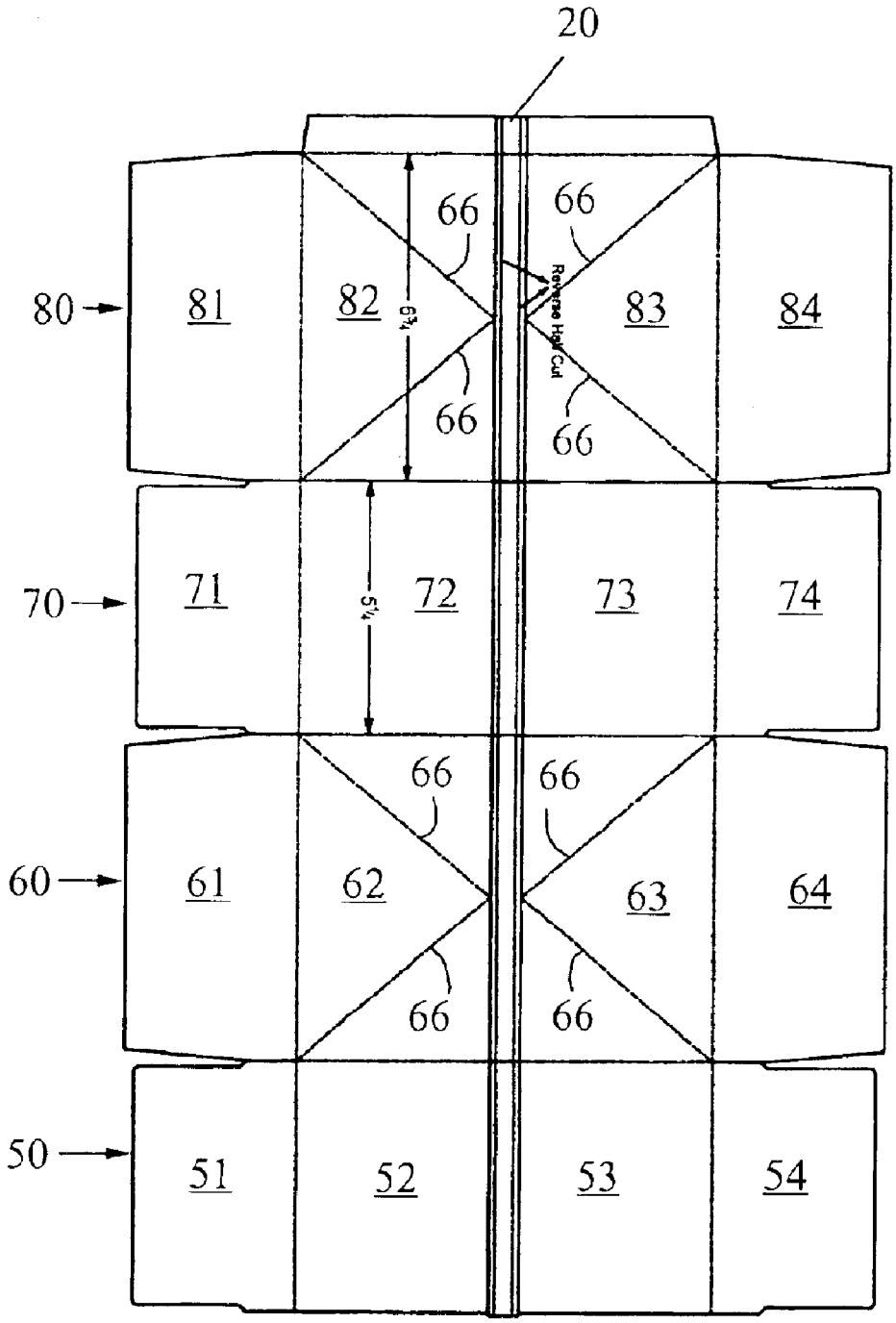
FIG. 5 is a plan view of the separable bowl forming carton blank.

Referring to FIG. 5, a blank 40 is shown for forming the separable bowl forming carton 10. The blank 40 includes four sections 50, 60, 70, and 80, wherein each section includes a top closure flap 51, 61, 71, and 81, respectively, an upper wall panel 52, 62, 72, and 82 respectively, a lower wall panel 53, 63, 73 and 83 respectively and a bottom closure flap 59, 64, 74, 84, respectively.

As seen in FIG. 5, the first section 50 defines the top closure flap 51, foldably connected to an upper left wall panel 52 which is separably connected to a lower left wall panel 53 foldably connected to the bottom closure flap 54.

The second section 60 includes the top closure flap 61, an upper front wall panel 62 foldably connected to the top closure flap. A lower front wall panel 63 separably connected to the upper front wall panel 62, and the bottom closure flap 54 foldably connected to the lower front wall panel. The upper front wall panel 62 and the lower front wall panel 63 are foldably connected to an edge of the upper left wall panel 52 and the lower left wall panel 53. Further, at least one and preferably both of the upper front wall panel 62 and the lower front wall panel 63 include bowl forming fold lines 66 which extend from a corner of the respective front wall panel to intersect at an apex adjacent to the tear strip 20. Depending upon the desired resulting configuration, the bowl forming fold lines 66 can terminate at or proximal to the tear strip 20. The bowl forming fold lines 66 can intersect, or merely converge at or adjacent the tear strip 20.

The third section 70 is typically similar to the first section 50 and defines the top closure flap 71, an upper right wall panel 72 foldably connected to the top closure flap, a bottom right wall panel 73 separably connected to the upper right wall panel, and a bottom closure flap 74 foldably connected to the bottom right wall panel. The upper right wall panel 72 and the bottom right wall panel 73 are foldably connected to an edge of the upper front wall panel 62 and the lower front wall panel 63, respectively.

The fourth section 80 defines the top closure flap 81, an upper rear wall panel 82 foldably connected to the closure flap, a lower rear wall panel 83 separably connected to the upper rear wall panel, and the bottom closure flap 84 foldably connected to the lower rear wall panel.

Similar to the upper front wall panel 62 and lower front wall panel 63, the upper rear wall panel 82 and lower rear wall panel 83 include bowl forming fold lines 66 which intersect at an apex adjacent to or at the tear strip.

The upper rear wall panel 82 and the lower rear wall panel 83 are foldably connected to the upper right wall panel 72 and lower right wall panel 73 respectively.

A joining or glue flap 90 extends from the upper rear wall panel and the lower rear wall panel.

The tear strip 20 extends between each of the upper and lower wall panels of the four sections (50, 60, 70 and 80). The tear strip 20 can include any of a variety of configurations including pull tabs, tear cords, perforations, reverse half cuts as well as score lines with a releasable adhesive.

Although the tear strip 20 is shown as bisecting each of the sections 50, 60, 70 and 80 to define equal size, upper and lower wall panels, it is understood the tear strip could be located to define different size upper and lower wall panels.

Further, although the blank 40 is set forth as having four sections 50, 60, 70 and 80 and hence four side walls, it is understood fewer side walls could be employed thereby providing for example a triangular footprint package, or more wall panels could be employed to define a pentagon, hexagon or a higher sided footprint carton.

The blank 40 can be formed from any of a variety of paperboard type materials as well as plastic or thermoplastic laminates or coated board such as a polycoated paperboard.

In formation of the separable bowl forming carton 10, the blank 40 is die cut and the fold lines formed.

Subsequently, each of the upper and lower wail panels of a given section 50, 60, 70 and 80 are folded relative to the adjacent upper and lower wall panels and the glue flap 90 is adhered to an inside portion of a free edge of the first section (in this configuration, the upper and lower left wall panels).

Either the top or bottom closure flaps are folded inward and sealed to form a substantially sealed enclosed end of the carton having four side walls. While it is believed that a sealed end will provide greater consumer satisfaction, it is understood the closure flaps can be merely tucked, without providing a sealed container.

The inner packets 12 are then disposed within the open-ended carton and the remaining of the top or bottom closure flaps are then folded and sealed to provide a sealed separable bowl forming carton 10.

In use, the consumer acquires the sealed separable bowl forming carton 10, which contains the two inner packets 12. The consumer then separates the upper and lower halves along the tear strip 20 to form two separate closed-end containers. The end walls can then be urged towards each other, thereby causing the sidewalls to flex along the bowl forming fold lines 60 and form a bowl periphery having a greater number of facets than the number of side walls in the sealed separable bowl forming carton. In the configuration shown, flexing of the left and right walls towards each other provides a bowl opening defined by six linear segments as seen in FIG. 4. The bowl forming fold lines 66 transform a single wall panel into three non-coplanar wall facets to provide two linear segments of the periphery of the bowl opening. Thus, in the configuration shown, the separated carton initially provides a "pre-bowl" having a bottom and four side walls having an opening defined by four linear segments. Upon folding along the bowl forming fold lines 66, additional facets are formed in the respective walls. Thus, the periphery of the resulting bowl has more facets than the number of side walls of the original packaging.

The consumer then opens the inner packet 12 and pours the food product of the inner packet to the shaped bowl, wherein the shaped bowl and be presented for consumption of the food product.

The blank 40 thus forms a sealed carton 10 having four side walls, with a sealed top and bottom, wherein at least one of the side walls (and preferably two opposing side walls) include at least two bowl forming fold lines 66. Actuation of the tear strip 20 separates the original carton 10 into two separate open top, closed bottom receptacles. Upon folding the side walls along the bowl forming fold lines 66, the resulting bowl has a periphery defined by a number of facets or segments that is greater than the number of side walls of the originally sealed carton.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

What is claimed is:

1. A packing assembly comprising:

(a) a single piece blank folded to define a closed primary container having four peripheral walls with top and bottom end closure flaps, the peripheral walls including a tear strip for selectively separating the container into top and bottom halves, wherein at least two of the peripheral walls of each of the top and bottom halves include bowl forming fold lines for forming at least a six sided bowl.

2. The packaging assembly of claim 1, wherein the four peripheral walls include a first pair of opposed walls and a second pair of longer opposed walls, the longer walls including the bowl forming fold lines.

3. The packaging assembly of claim 1, further comprising a sealed packet within the primary container.

4. The packaging assembly of claim 1, wherein the primary container is sealed.

5. A container assembly comprising:

(a) a sealed outer container having a top wall, a bottom wall and at least two interconnecting side walls, the side walls including a tear strip or separating the container into an upper half and a lower half, at least one of the at least two interconnecting side walls including fold lines to form facets within the at least one side wall allowing for the reshaping of the upper half and the lower half; and (b) a sealed inner container encompassed within the sealed outer container.

6. A separable bowl forming packaging comprising:

(a) a sealed bowl forming container having a given number of side walls and having a tear strip located to form two separate bowls, each bowl having a sealed end, the sealed bowl forming container including at least one side wall having a bowl forming fold line forming at least one of the separate bowls with a periphery defined by a number of facets greater than the number of side walls; and (b) at least one inner package within the sealed bowl forming container, the inner package including a food product.

7. A bowl forming food packaging, comprising:

(a) a closed outer container having a plurality of sides walls, a closed top and a closed bottom, each of the side walls including a tear strip an at least one of the side walls including bowl forming fold lines to define a number of bowl forming facets, the number of bowl forming facets being greater than the plurality of the side walls.

8. A blank for forming a separable bowl forming packaging, the blank comprising:

(a) a first section, a second section foldably connected to the first section, a third section foldably connected to the second section and a fourth section foldably connected to the third section;

(b) each of the first, second, third and fourth sections including a top closure flap, an upper wall panel, a lower wall panel and a bottom closure flap, the upper wall panel and the lower wall panel of each section being spaced by a tear strip; and (c) at least one each of the upper wall panels and lower wall panels including at least two bowl forming fold lines to define a bowl periphery having at least five sides.

* * * * *